US006135163A

United States Patent [19]

Wahhoud et al.

[11] Patent Number: 6,135,163

[45] Date of Patent: Oct. 24, 2000

[54] METHOD AND APPARATUS FOR COMPENSATING WARP THREAD TENSION OR ELONGATION VARIATIONS DURING LOOM SHEDDING

[75] Inventors: Adnan Wahhoud, Lindau-Bodolz, Germany; Josef Hehle, Hoerbranz, Austria

[73] Assignee: Lindauer Dornier Gesellschaft mbH, Lindau, Germany

[21] Appl. No.: 09/456,237

[22] Filed: Dec. 7, 1999

[30] Foreign Application Priority Data

Dec. 7, 1998 [DE] Germany ..... 198 56 308
Apr. 9, 1999 [DE] Germany ..... 199 15 952

[51] Int. Cl.[7] ..... D03D 49/14

[52] U.S. Cl. ..... 139/114; 139/97

[58] Field of Search ..... 139/101, 102, 139/100, 108, 107, 430, 433, 20, 24, 22, 29, 33, 97, 114, 115, 386, 109, 110

[56] References Cited

U.S. PATENT DOCUMENTS

| | | | |
|---|---|---|---|
| 1,077,125 | 10/1913 | Doughty | 139/103 |
| 1,254,306 | 1/1918 | Bowen | 139/103 |
| 3,727,646 | 4/1973 | Mares et al. . | |
| 3,759,299 | 9/1973 | Selivanov et al. . | |
| 3,871,419 | 3/1975 | Pfarrwaller | 139/97 |
| 4,108,214 | 8/1978 | van Mullekom . | |
| 4,262,706 | 4/1981 | Popp et al. | 139/103 |
| 6,003,564 | 12/1999 | Cahuzac et al. | 139/97 |

FOREIGN PATENT DOCUMENTS

| | | |
|---|---|---|
| 0409306 | 1/1991 | European Pat. Off. . |
| 0877110 | 11/1998 | European Pat. Off. . |
| 2086424 | 12/1971 | France . |
| 2339014 | 8/1977 | France . |
| 2659530 | 7/1977 | Germany . |
| 3216903 | 11/1983 | Germany . |
| 3532798 | 4/1986 | Germany . |
| 250056 | 5/1948 | Switzerland . |

*Primary Examiner*—Andy Falik
*Attorney, Agent, or Firm*—W. F. Fasse; W. G. Fasse

[57] ABSTRACT

Different groups of warp threads are subject to different variations of warp thread tension during shed changes, especially when weaving a fabric having portions such as fabric edges with different weave binding patterns. To provide different warp thread tension compensation for the different thread groups, a cam-like first tensioning module is arranged protruding from the circumferential surface of the backrest along the entire operating width thereof. Second and third tensioning modules are arranged and engaged over the first tensioning module at particular selected axial locations on the backrest. While the second and third tensioning modules provide a constant deflection path distance for second and third warp thread groups guided thereover, the first tensioning module provides a varying deflection path distance for the first warp thread group guided thereover, depending on the oscillating rotational angular position of the backrest. The backrest oscillatingly rotates under a passive compensating spring tension and/or under a positive actuation mechanism coupled to the main loom shaft. The respective warp thread tension of each group of warp threads can be compensated differently or independently from the other groups. The arrangement can be easily reconfigured in a modular fashion to be adapted to the needs of weaving different product articles.

27 Claims, 4 Drawing Sheets

METHOD AND APPARATUS FOR COMPENSATING WARP THREAD TENSION OR ELONGATION VARIATIONS DURING LOOM SHEDDING

PRIORITY CLAIM

This application is based on and claims the priority under 35 U.S.C. §119 of German Patent Applications 198 56 308.6, filed on Dec. 7, 1998, and 199 15 952.1, filed on Apr. 9, 1999.

FIELD OF THE INVENTION

The invention relates to a method for compensating and thereby avoiding the variations in tension and/or elongation in warp threads during shed changes in a loom, whereby the warp threads are guided from a warp beam over a backrest that oscillates and is supported to be rotatable about its lengthwise central axis, for producing a woven web, and particularly a woven web that includes two different weave binding patterns or constructions. The invention further relates to an apparatus for carrying out such a method including means for applying an oscillating motion onto the backrest.

BACKGROUND INFORMATION

During a weaving operation for forming a woven fabric web on a loom, the warp threads are subjected to different warp tension variations, particularly during the changing or alternation of the shed. Namely, when the shed is open for the purpose of the weft insertion and beat-up, the warp tension is at a maximum value, and during the change or alternation of the shed the warp tension is at a minimum value. This alternating tension applied to the warp leads to relatively high loading and demands placed on the warp threads, which give rise to warp thread breaks. Moreover, the reduced or minimum warp tension that is established during the change of shed can impair the proper guidance and manipulation of the warp threads. Namely, if the warp thread tension is too low and therefore all or particular ones of the warp threads are too slack, the respective warp threads can become entangled or hung-up on each other and thereby impair the proper opening of the next shed. Such tangling or sticking of the warp threads are also often the cause of warp thread breaks and can lead to so-called weft loops or weft fold-backs in the case of looms using a pneumatic weft insertion.

The above described problems have been addressed in looms using a closed-shed shed formation for carrying out a linen weave or plain weave operation. In such a case, the above mentioned problems have been at least partially resolved by supporting the backrest either fixedly or rotatably on swing arms, such that the backrest carries out controlled or uncontrolled periodic swinging movements for compensating the warp tension variations during the shed changes. Such methods and arrangements are disclosed in German Patent 32 16 903, German Patent 35 32 798, and European Patent Application 0,409,306, for example.

The above described problems regarding the varying tension load on the warp threads become even more pronounced and more difficult to resolve when weaving a fabric using more than one weave binding pattern or binding type. One typical case is when the fabric edges are to have a different weave binding pattern in comparison to the rest of the fabric. For example, if the fabric edges are to be woven with a 2/2 weave binding pattern in order to provide a strong and stable fabric edge, while the main body width of the fabric shall have a so-called linen weave or plain weave, i.e. a 1/1 weave binding pattern, then the respective groups of warp threads forming the fabric edges on the one hand, and forming the main body width of the fabric on the other hand, will be subjected to different degrees of tension variations between the open shed condition and the closed shed condition. If a uniform tension compensation is applied to all of the warp threads, then the tension of one of the thread groups will be overcompensated while the tension of the other thread group will be undercompensated. In any event, the above mentioned interfering problems relating to tangling of the warp threads, and a resulting disruption of the weaving process, will still arise in at least one of the groups of warp threads.

German Patent Laying-Open Document 26 59 530 discloses a loom in which the backrest is so arranged to carry out a certain translation movement for the purpose of compensating tension variations, which arise in the warp threads guided over the backrest as a result of the successive shed changes. Additionally, an auxiliary guide for a number of fabric edge warp threads is provided near at least one end of the backrest. This auxiliary guide is arranged and adapted to carry out a translational movement independently of the backrest, under the influence of an adjustable load acting thereon. Due to its independent translational movement, this auxiliary guide can easily follow and thereby compensate the tension variations that result from the successive shed changes. Thus, the actually arising tension variations in the respective fabric edge warp threads can be considerably reduced. However, also in view of the independent arrangement and motion of the auxiliary guide that is allocated to the warp threads of the fabric edge in combination with the tension compensating apparatus allocated to the backrest itself, the overall arrangement results in a considerable additional cost, effort, and complexity in the manufacturing, operation, and maintenance of the loom.

SUMMARY OF THE INVENTION

In view of the above it is an object of the invention to provide a method and an associated apparatus for compensating the relatively reduced tension in the warp threads that arises during shed changes, so as to achieve a stable and especially uniform and constant warp thread tension conditions in all of the warp threads. More particularly, the invention aims to provide a method and an apparatus that is able to provide different degrees or amounts of tension compensation for different groups of warp threads, which is especially applicable to the production of a woven fabric comprising more than one type of weave binding pattern. Another object of the invention is to avoid the need of re-equipping a loom for carrying out the compensation of the elongation or tension variations in the warp threads dependent on the particular woven fabric that is to be produced, in a loom equipped with a modularly constructed backrest. The invention further aims to avoid or overcome the disadvantages of the prior art, and to achieve additional advantages, while providing a simplified and reliable method and apparatus, as apparent from the present specification.

The above objects have been achieved according to the invention, in a method for compensating the elongation or tension variations caused during shed changes in the warp threads that are guided from a warp beam over a backrest, which is supported to be oscillatingly rotatable about its lengthwise central axis. At least one tensioning module is provided on a selected portion of the backrest. The warp threads are divided into at least first and second warp thread groups. The first warp thread group is guided and deflected over the first tensioning module while the second warp thread group is not deflected over the first tensioning module. As a result, the threads of the two warp thread groups are respectively caused to be deflected over different deflection path distances. Thus, during the weaving process, the elongation or tension variation of the first warp thread group is compensated independently of the elongation or tension variation of the second warp thread group.

The above objects have further been achieved according to the invention, in a loom arrangement comprising a warp beam, a backrest that is supported so as to be oscillatingly rotatable, a motion transfer mechanism or transmission linkage that is adapted to apply an oscillation motion to the backrest, and at least a first tensioning module arranged on the backrest over at least a portion or all of its working width. Thereby the warp threads guided over the first tensioning module can be subjected to a warp tension compensation independently and differentially in comparison to warp threads that are guided over the backrest arrangement without passing over the first tensioning module.

According to the invention, the backrest equipped with at least one first tensioning module is oscillatingly rotatable in such a manner so that it can be rocked or oscillated back-and-forth about its lengthwise central axis in rhythm with the shed changes. Thereby, the selected group of warp threads passing over the area of the first tensioning module are cyclically deflected and then not deflected by the tensioning module, which compensates the reduced warp thread tension during shed changes by forcing the respective warp threads deflected over the first tensioning module to travel a greater thread path distance.

The first tensioning module of the backrest according to the invention comprises at least one component in the form of a cam or the like having an eccentric cam surface, which can be arranged adjustably as needed or desired on the outer circumferential surface of the backrest, preferably to extend entirely along the axial working length or width thereof. During the shed changes, the first tensioning module is effective on the warp, or particularly the group of warp threads guided over the first tensioning module, in order to compensate the elongation or tension variations of the warp threads. In a preferred embodiment, the first tensioning module extends along the entire working length of the backrest, generally corresponding to the weaving width of the main body of the finished fabric. Thereby, this tensioning module provides a uniform warp thread tension compensation along the entire weaving width. Such a configuration or embodiment is particularly used for producing a woven fabric that has a uniform weave pattern over the entire weaving width. A different warp tension compensation can be achieved in selected zones along the weaving width, however, by providing one or more second tensioning modules at the appropriate locations on the backrest as described below.

The first tensioning module effectively forms a tensioning cam on the backrest, and in order to achieve this preferably in an adjustable or modular manner, the module may be connected at several points, for example by screws, bolts or the like, onto the circumferential surface of the backrest. In order to make surfacial contact seating on the outer circumferential surface of the backrest, the first tensioning module has an arc-shaped recess along its back surface, having an internal radius of curvature $r_1$, which corresponds to the outer radius of the backrest. On the other hand, the exposed outer circumferential surface of the module has a second radius of curvature $r_2$ that is different than and particularly less than the radius $r_1$, and more particularly less than ½ of the radius $r_1$.

As a further example, if a woven fabric is to be produced having fabric edges with a weave binding pattern that is different from the weave pattern of the rest of the fabric, or if other sections of the web at one or more locations across the weaving width are to be woven with a weave binding pattern that differs from the main weave pattern, or for example matches the weave pattern of the fabric edges, then the invention provides for a second and/or a third tensioning module connected to or mounted on the backrest. The respective warp threads of the different sections of the woven fabric that are to have different weave patterns, and particularly which are thereby subjected to different warp tension variations during the weaving operation, are divided into respective warp thread groups. Each respective warp thread group is then guided over an associated one of the tensioning modules. The respective modules may each provide a different tension compensation characteristic.

The third and fourth tensioning modules preferably are configured and arranged to be slidingly pushed onto the backrest while reaching and engaging around the first tensioning module that was described above. In this manner, an inner contour or fitting notch or recess of the second and third module, respectively, fits onto and operatively engages the first module to prevent relative rotation therebetween between. Thus, the first, second and third tensioning modules will all move rotationally together with the backrest, but the respective modules can each provide a different tensioning characteristic by having a different cam surface characteristic, namely having a different external radius relative to the lengthwise central axis of the backrest, and/or having a different angular or rotational orientation relative to the other modules. The presently described construction of the backrest with the tensioning modules arranged thereon also allows for the simple modular repositioning or reconfiguration of the several modules on and along the backrest. Namely, the position of selected modules can easily be adjusted along the weaving width, or entirely different tensioning modules can be mounted on the backrest to replace the modules used for a prior weaving operation. In this manner, it becomes very simple to achieve exactly the tension compensation that is necessary for a particular weaving run, in view of the simple modular construction and rearrangement of the components on the backrest.

In order to enable the backrest to carry out an elongation or tension compensation in the warp during each shed change, the two opposite ends of the backrest are provided with bearing shaft stubs that are respectively rotatably supported in corresponding bearings, and the backrest is connected to at least one lever arm that is arranged and secured to the backrest so as to prevent relative rotation therebetween, for example the lever arm is secured near one of the bearing shaft stubs of the backrest. The lever arm transmits to the backrest an oscillating motion that arises from the shed formation. A motion transfer mechanism or transmission linkage is connected to the just mentioned lever arm to transmit the oscillating motion from a drive arrangement of the loom to the backrest. In this case, the backrest is positively controlled to carry out an enforced oscillating or rocking rotational motion. A positive or enforced control of the backrest is provided when the rotating motion of the backrest is derived from the main drive shaft of the loom, or if the backrest is rotationally driven independently of the main drive shaft of the loom, for example by means of an electric motor drive arrangement that is operatively connected to the backrest.

Instead of, or in addition to, such a positive or enforced control and drive arrangement, the backrest may be spring loaded. Such a spring biasing provides a passive unconstrained control of the oscillating rotational rocking of the backrest, because the backrest will be able to automatically react to and compensate tension variations in the warp threads that are deflected over the backrest. Namely, the spring biased backrest will automatically "take up the slack" in the warp threads.

These embodiment features of the invention provide that a second uncontrolled oscillating motion can be provided for the backrest, in addition to or superimposed on the positively controlled and enforced oscillating motion about the lengthwise central axis of backrest. This combination or superposition of the two types of motion can be selected as desired, whereby preferably the positively controlled and enforced motion always dominates over the uncontrolled motion. If the backrest is not to be driven or operated in a positively controlled manner for weaving a particular woven fabric or other article, it is a simple matter to decouple the positively controlled motion transmission from the modular backrest. Thereupon, the backrest will only be subject to the non-positive or non-controlled influence of at least one spring. On the other hand, when the backrest is supposed to carry out a positively controlled oscillating motion, the backrest may additionally be spring loaded together with the positively enforced actuation, in which case the positive control or enforced actuation is dominant over the spring loading.

The invention achieves the following advantages. The loading and demands placed on the warp threads are reduced, and thereby the number or frequency of warp thread breaks are reduced. The breaking strength or tearing resistance of the fabric edge portion of the woven fabric can be increased. By reducing or avoiding warp entanglements, the fabric weave density of a woven fabric produced on the loom can be increased. Handling of the equipment can be improved and simplified. The amount and complexity of assembly and equipping effort to be carried out on the loom when the product article is changed can be reduced.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
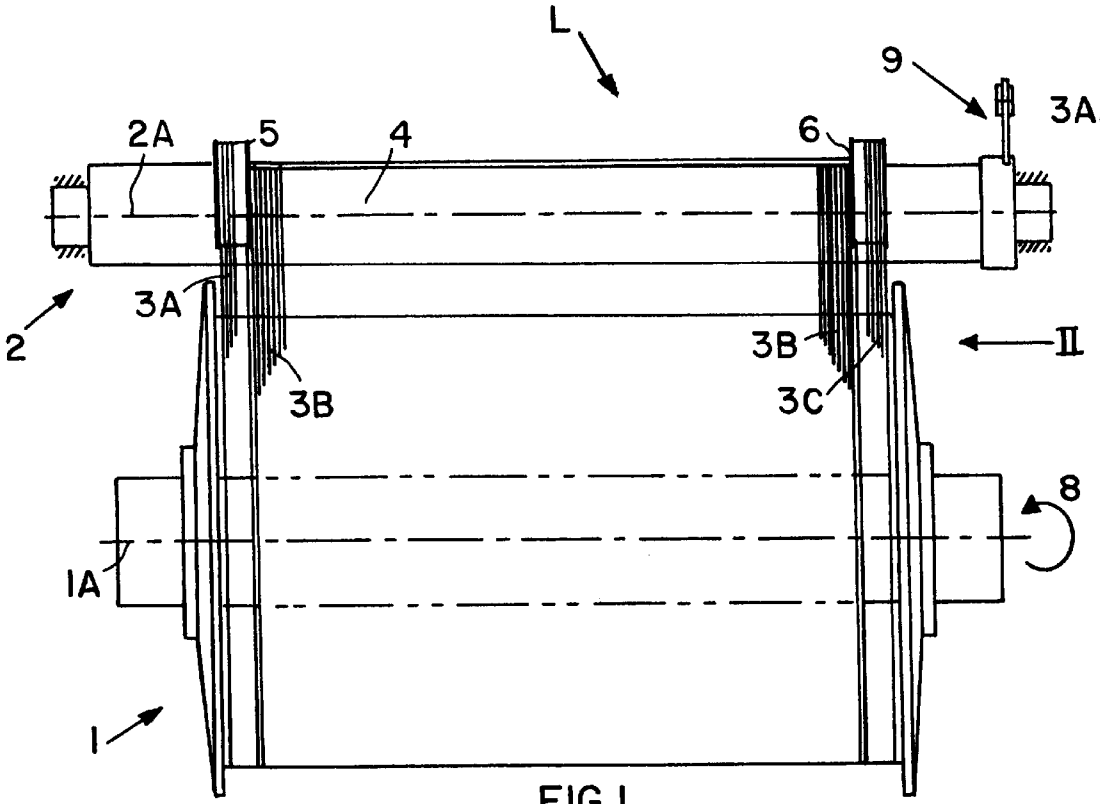
FIG. 1 is a schematic front elevation view of the warp beam and backrest unit having modular components according to the invention.

FIGS. 1 to 5 show the components of a loom L that are directly related to a first embodiment of the invention. The entire loom, i.e. the other components of the loom L, are not shown, but can have any conventionally known form, construction and operation. FIG. 1 shows warp threads 3 rolled or wrapped on a warp beam 1, whereby solid lines show the warp beam almost full and dashed lines show the warp beam almost empty to demonstrate that the operation of the invention is the same regardless of the amount of warp thread supply on the warp beam. The warp beam 1 is supported so as to be rotatable in the direction of arrow 8 about its lengthwise central axis 1A in the loom L. More particularly, the warp threads 3 comprise three warp thread groups 3A, 3B and 3C that will respectively be used for different sections of the weaving width of the woven fabric to be produced. A first warp thread group 3B will form the warp of the main body of the fabric, while a second warp thread group 3A and a third warp thread group 3C will respectively form the warp of fabric edge portions of the woven fabric.

Figure 3:
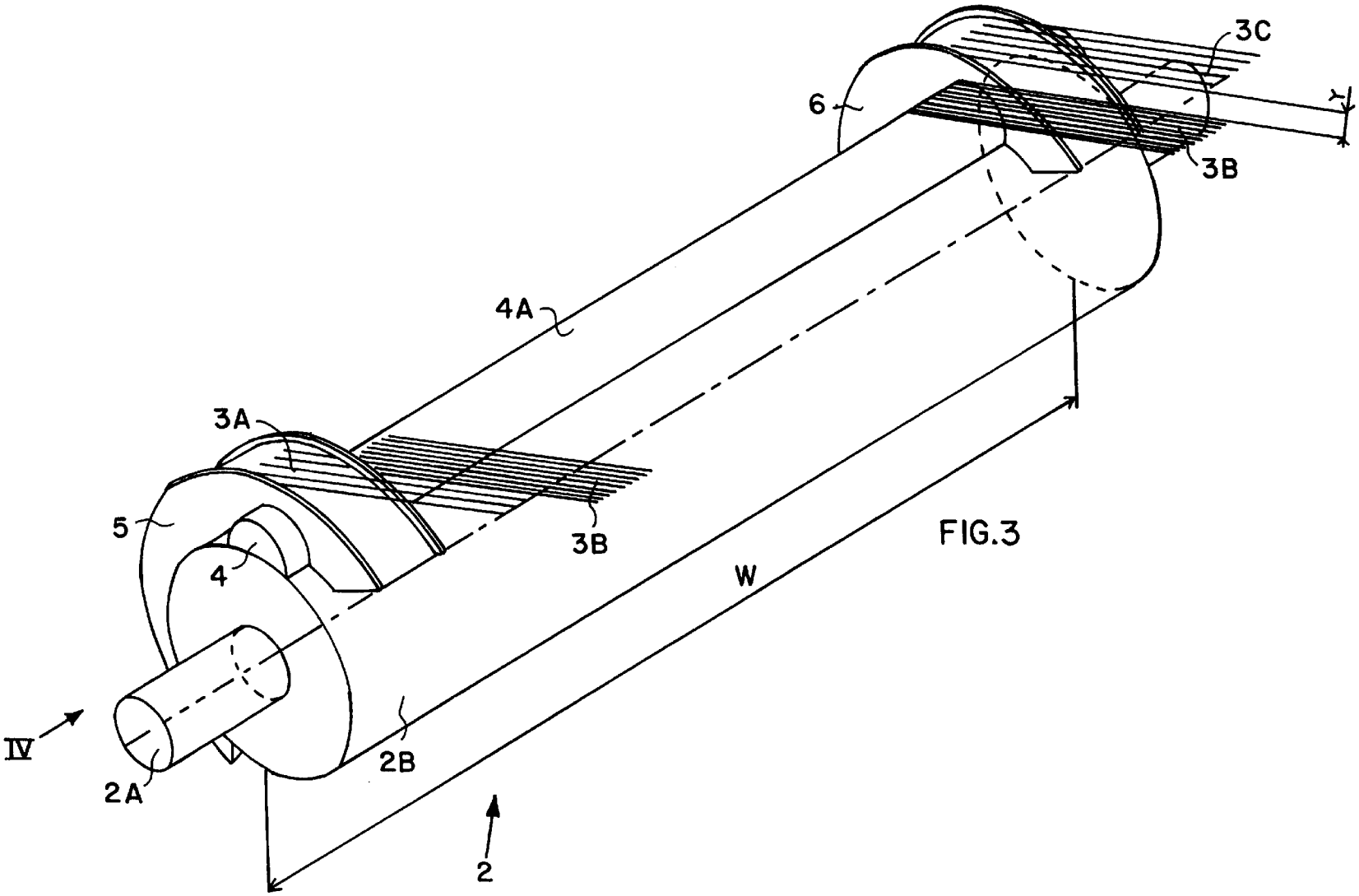
FIG. 3 is a perspective view of the backrest having modular tensioning cams or modules arranged thereon.

FIG. 1 further shows a backrest 2 that is supported to be at least rockingly or oscillatingly rotatable about its lengthwise central axis 2A in the loom L. The component generally called the backrest 2 herein, could also be termed the backrest beam 2, because the overall backrest arrangement comprises additional components mounted on the backrest beam. Namely, modular components, referred to as first, second and third tensioning modules 4, 5 and 6 herein, are mounted on the backrest beam or backrest 2. The backrest 2 thus carries the tensioning modules 4, 5 and 6 along its working length or operating width W as best shown in FIG. 3.

The second and third warp thread groups 3A and 3C are guided over the over outer surfaces of the second and third tensioning modules 5 and 6 respectively, and are then delivered to the heald frame or heald shafts, which are not shown, for forming a stable or strong fabric edge. For example, the fabric edge can be woven with a 2/2 weave binding pattern. On the other hand, the first warp thread group 3B is guided over the outer circumferential surface 2B of the backrest 2 toward the heald shafts, which are not shown. The first warp thread group 3B will be used to form the main body of the woven fabric, for example with a plain or 1/1 weave pattern.

Figure 2:
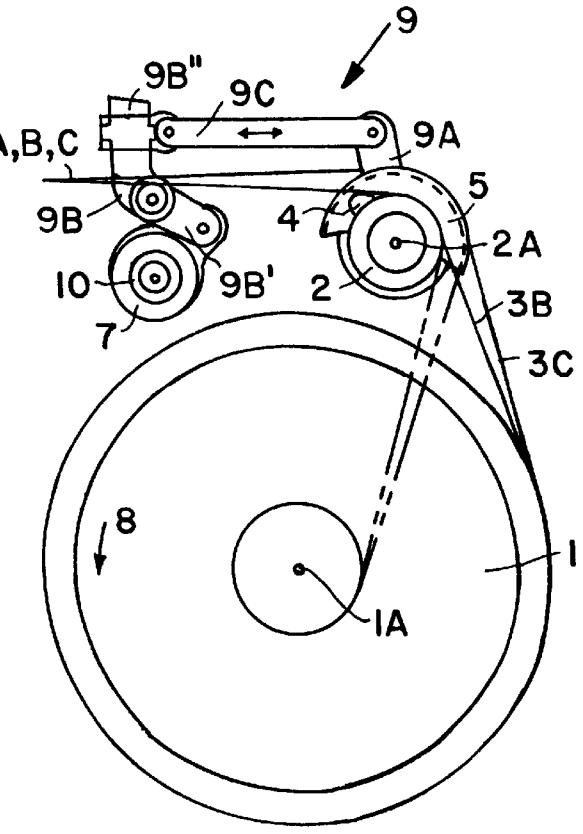
FIG. 2 is a side view of the unit shown in FIG. 1 in the direction of arrow II, with a positively controlled motion transfer to the backrest.

As can be seen especially in FIG. 2, the warp threads of the second warp thread group 3A and of the third warp thread group 3C are directed with a comparatively larger deflection looping angle and particularly a larger deflection looping path distance over the outer circumferential surfaces of the second tensioning module 5 and the third tensioning module 6, while the warp threads of the first warp thread group 3B are guided over the outer circumferential surface 2B of the backrest 2 and thereby have a comparatively shorter deflection and looping path over the backrest arrangement, in the non-compensating angular rotational position of the backrest 2 shown in FIG. 2. In this position as shown in FIG. 2, while the warp threads of the first warp thread group 3B may also be slightly deflected over the outer surface 4A of the first tensioning module 4, this first tensioning module 4 comes into play especially during a shed change as will be described below.

Namely, FIG. 2 shows the non-compensating angular operating position of the backrest 2 for an open shed. In this position, the warp threads of the second and third warp thread groups 3A and 3C are pre-tensioned over the longer deflection path provided by the second and third tensioning modules 5 and 6. Since the threads of the second and third warp thread groups 3A and 3C going into the fabric edges are not subjected to as great a tension variation as the threads of the first warp thread group 3B, the second and third tensioning modules 5 and 6 will maintain substantially the same tension or the same deflection path distance throughout the shed change, i.e. regardless of the angular rotational position of the backrest 2.

On the other hand, the warp tension in the warp threads of the first warp thread group 3B changes or varies considerably during the shed change. In order to compensate for such a warp thread tension variation in the first warp thread group 3B, the backrest 2 is rotated about its lengthwise central axis 2A, clockwise in the view of FIG. 2 roughly ¼ of a complete rotation to a compensating angular position (not shown), so that the outer cam surface 4A of the first tensioning module 4 deflects the warp threads of the first warp thread group 3B over an increased deflection path distance to take up the slack in the warp threads of this group during the shed change. Note that in this compensating angular position, the second and third tensioning modules will still apply the same deflection to the second and third warp thread groups as in the above described non-compensating position. Thus, it could be said that the degree of tension compensation provided by the second and third tensioning modules is essentially zero. This result is achieved because the second and third tensioning modules 5 and 6 have a circular arc-shaped circumferential surface that spans over a sufficient angular range (e.g. greater than that of the first tensioning module, and particularly greater than 180° ) to maintain a uniform deflection path distance for the warp threads of the second and third warp thread groups 3A and 3C for all rotational oscillation positions of the backrest 2. Alternatively, if some degree of compensation of the tension of the warp threads of the second and third warp group 3A and 3C were required, the angular range and/or the outer circumferential shape of the second and third tensioning modules 5 and 6 could be reconfigured accordingly.

In order to oscillatingly rotate the backrest 2 about its axis 2A, in synchronism with the shed changing operation, a motion transfer mechanism or transfer linkage 9 is connected between the backrest 2 and an eccentric member 10 mounted on the main shaft 7 of the loom. The transmission linkage 9 comprises a first lever arm 9A that is rigidly connected to the backrest 2 to prevent relative rotation therebetween. The transmission linkage 9 further comprises a double lever or rocker 9B that is pivotally supported and includes a first lever arm 9B' that is connected to or follows the eccentric member 10 mounted on the main shaft 7, and a second lever arm 9B" that is articulately connected to a coupling link 9C which interconnects the lever arm 9A with the double lever rocker 9B. In this manner, the backrest 2 carries out an oscillating or rocking rotation positively in synchronism with the rotation of the main shaft 7 of the loom.

FIG. 3 shows the backrest 2 with the tensioning modules 4, 5 and 6 according to the invention arranged thereon. The first tensioning module 4 is arranged to extend along the entire operating width W of the backrest 2 on the outer circumferential surface 2B thereof. The mounting and connection of the tensioning module 4 onto the outer circumferential surface 2B of the backrest 2 can be carried out in any manner. For example, the module 4 may be screwed, bolted, clipped or clamped or otherwise removably secured to the backrest 2. Alternatively, the module 4 may be permanently welded, glued, riveted, or the like onto the backrest 2. The specific details of this mounting and connection are not limitations on the subject matter of the present invention. It can also be seen in FIG. 3 that the first tensioning module 4 may have the configuration of essentially half of a cylindrical rod. Alternatively, the tensioning module 4 can have an outer surface configuration defined by a portion of an oval or ellipse or varying cam surface.

Figure 4:
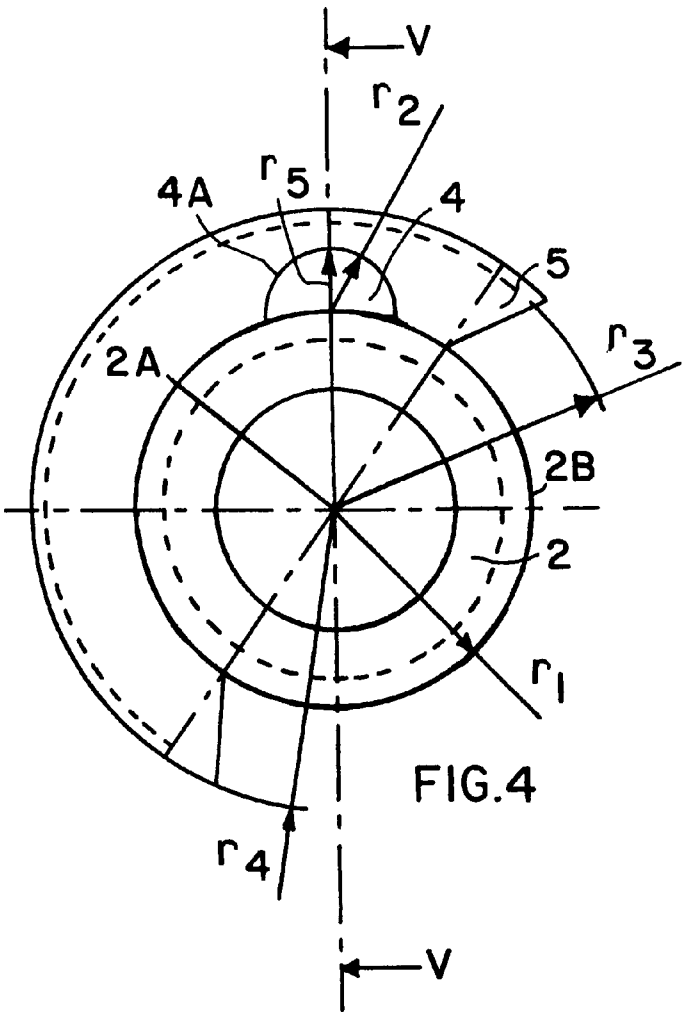
FIG. 4 is an end view of the backrest arrangement shown in FIG. 3 as seen in the direction of arrow IV.

The arrangement of the first tensioning module 4 on the backrest 2 is shown in further detail in FIG. 4. An important feature that is evident in FIG. 4 is that the free or outer circumferential surface 4A of the first tensioning module 4 has an outer radius of curvature $r_2$ that is significantly smaller than (e.g. less than ½ of) the radius $r_1$ of the backrest 2. In this context, the radius $r_1$ of the backrest 2 is defined with respect to the lengthwise central axis 2A of the backrest 2, while the radius of curvature $r_2$ of the first tensioning module 4 is defined as the radius of the arc-shaped outer surface 4A of the module 4, e.g. relative to the outer surface 2B of the backrest 2. In this manner, the first tensioning module 4 has the effect of a cam protruding from and mounted on the outer surface 2B of the backrest 2. The maximum outer protrusion radius of the surface 4A relative to the axis 2A is given by $r_5$ which is equal to $r_1+r_2$ for example.

FIGS. 3 and 4 further show the second and third tensioning modules 5 and 6, which each have the form of a segment cut out of a U-profile ring. The inner surface of each of the second and third tensioning modules 5 and 6 comprises a contour that matches the outer contour made up of the outer surface 4A of the first tensioning module 4 arranged on and protruding from the outer surface 2B of the backrest 2. In this manner, the second and third modules 5 and 6 can be slidingly mounted on the backrest 2 with the module 4 slidingly received and engaged in a corresponding cut-out of the inner contour of each of the modules 5 and 6, in the manner of a spline engaging a keyway or the like. In this manner, the second and third modules 5 and 6 are rotationally rigidly secured, i.e. secured against relative rotation, on the module 4 which in turn is secured to the backrest 2 in the manner described above. The modules 5 and 6, once positioned to the desired axial location, may be secured by bolts, screws or the like to prevent an axial sliding displacement thereof along the backrest 2.

Figure 5:
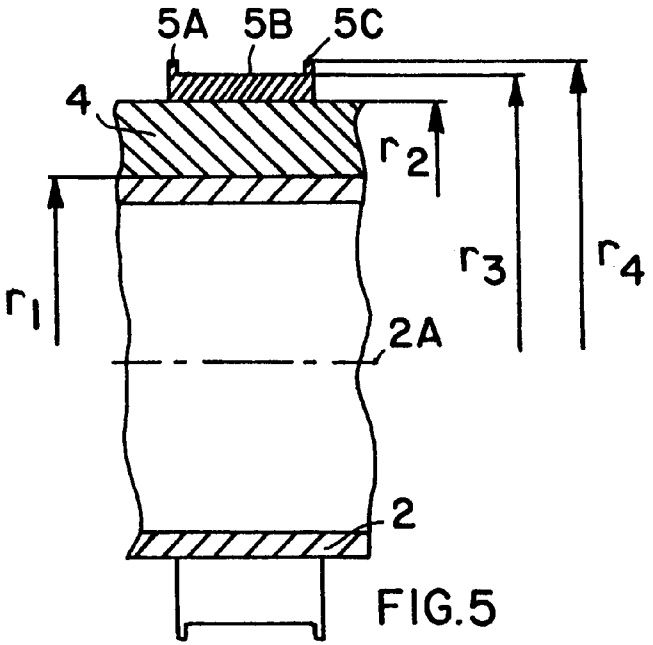
FIG. 5 is a sectional view of the backrest arrangement shown in FIG. 4, as seen along the section plane V—V.

In the enlarged sectional view of FIG. 5, the U-profile shape of the second tensioning module 5 can be seen in detail. Particularly, the U-profile shape includes a cylindrical circumferential surface 5B with the radius of curvature $r_3$ bounded along the two side edges thereof by protruding rims 5A and 5C that protrude radially outwardly to a radius $r_4$. The module 6 can have a similar U-profile configuration with a circumferential surface 6B bounded by protruding rims 6A and 6C. The warp threads of the second warp thread group 3A are smoothly and flatly distributed and guided over the circumferential surface 5B of the module 5, while the protruding rims 5A and 5C prevent the warp threads of this group from falling or jumping off of the module 5. Similar considerations apply to the module 6. The width of the circumferential surface 5B of course depends on the width of the respective corresponding group of warp threads, which in turn depends on the width of the fabric edge or other fabric section that is to be formed using these threads.

The above arrangement of second and third tensioning modules 5 and 6 on a backrest 2 provided with a first tensioning module 4 that extends continuously along the entire operating width W of the backrest 2 achieves a modular and easily reconfigurable that can provide a variable warp thread tension compensation with different compensating characteristics for different warp thread groups as has been demonstrated by the example above. The particular shape, angular range, radius, axial width, and axial location of the respective tensioning modules can be varied, selected, and/or adjusted as needed to achieve the required degree of tension compensation for each respective group of warp threads. The radii of the thread deflecting surfaces can also vary over the relevant angular range, to provide a varying cam effect.

Figure 6:
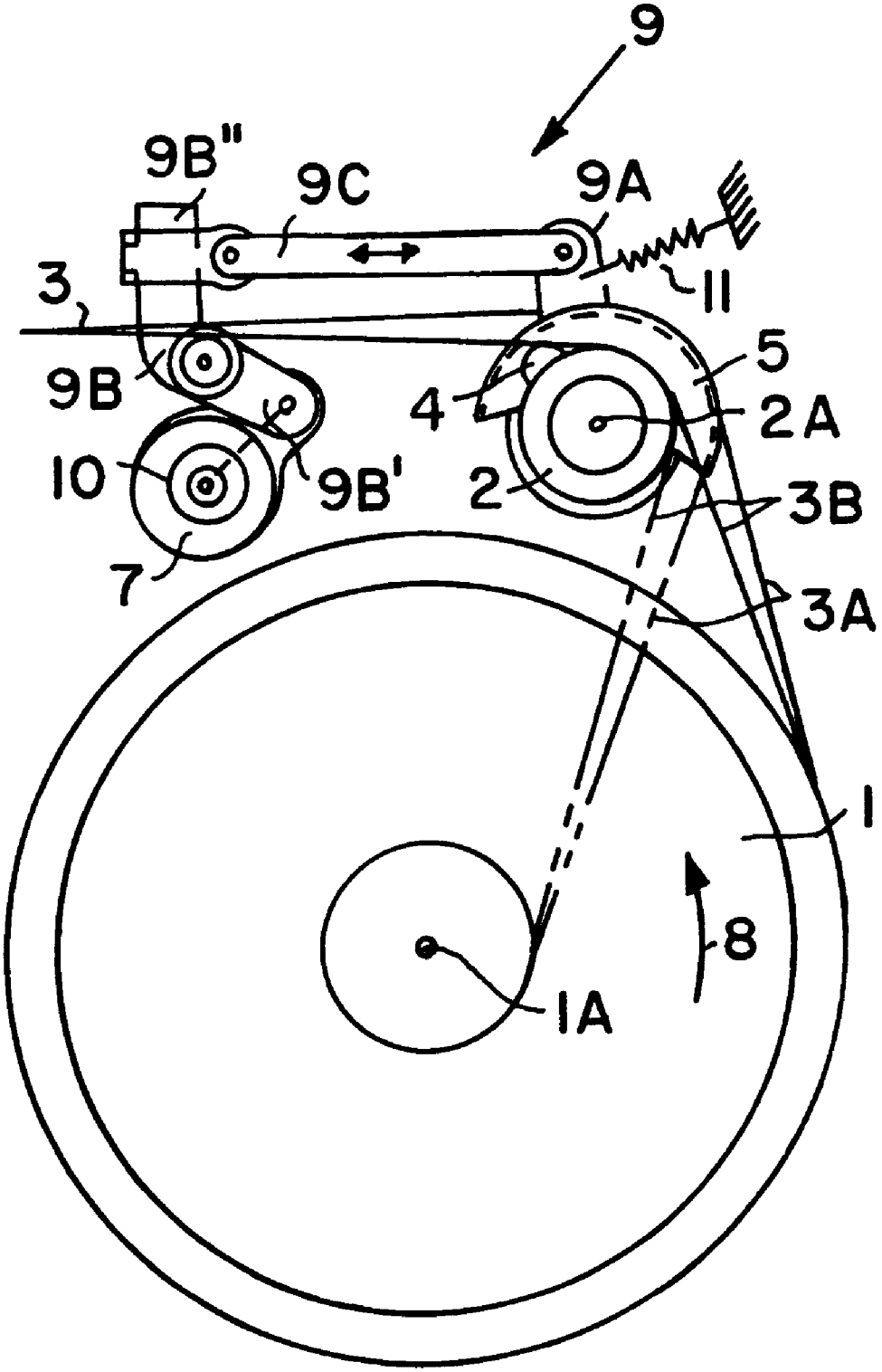
FIG. 6 is a side view similar to that of FIG. 2, but showing an arrangement with means for the positive controlled oscillating movement combined with means for the unconstrained oscillating movement of the backrest about its lengthwise central axis.

FIG. 6 shows a further embodiment feature in a view similar to that of FIG. 2. Components in the embodiment of FIG. 6 that correspond to those of the embodiment described above are labelled with the same reference numbers, and a redundant description will be omitted here. The operation of the present embodiment also corresponds to that described above, except as follows. In the embodiment of FIG. 6, the backrest 2 may be positively controlled and oscillatingly driven about its axis 2A by a positive motion transmission linkage 9 as described above. In addition thereto, at least one compensating spring element 11 is connected, for example to the lever arm 9A, so as to apply a rotational bias force to the backrest 2 about the axis 2A. By selectively coupling or decoupling the transmission linkage 9 to the lever arm 9A, the positive controlled oscillating actuation of the backrest 2 can be selectively engaged or disengaged. If the positive actuation is engaged, it is dominant over the passive influence of the spring element 11. If the positive actuation is disengaged, for example by disconnecting the coupling link 9C at either end thereof, then the spring element 11 will continue to apply a passive tensioning bias to the backrest 2. Thereby, any reduction or slackening of the tension in the warp threads 3 will result in a compensating rotation (clockwise in FIG. 6) of the backrest 2 so that the first tensioning module 4 takes up the slack and thereby passively compensates for the tension variation in the first warp thread group 3B. It should be understood that the spring element may be embodied by single or plural mechanical springs, pneumatic springs, elastomeric springs, or the like. Similarly, the positively actuating transmission mechanism may comprise a rod linkage as shown, or a gear drive, chain drive, toothed belt drive, shaft drive, or direct motor drive, in any configuration known to persons skilled in the art.

In the above described manner, it is very simple and quick to adjust the tension compensating operation of the backrest 2 to the particular needs for weaving any particular article. Namely, a positive oscillating actuation of the backrest 2 can be engaged when needed for a particular weaving operation, but can also be disengaged whenever a merely passive spring-biased warp tension compensation is needed for a particular weaving operation. This feature in combination with the above described modular configurability of the tension modules 4, 5 and 6 leads to a very simple, yet very broadly adaptable backrest arrangement for achieving variable and adaptable warp tension compensation.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A backrest arrangement for a loom, comprising:

a backrest beam that is supported to oscillatingly rotate about a backrest axis and that has a cylindrical outer backrest surface with a backrest radius ($r_1$) about said backrest axis; and first and second warp tensioning modules that are mounted respectively on said backrest beam;

wherein said first warp tensioning module has a first warp guide surface that extends over a first angular range of less than 180° relative to said backrest axis and that protrudes radially outwardly beyond said cylindrical outer backrest surface to a maximum first surface radius ($r_5$) greater than said backrest radius ($r_1$) relative to said backrest axis;

wherein said second warp tensioning module has a second warp guide surface that extends over a second angular range greater than said first angular range relative to said backrest axis and that protrudes radially outwardly beyond said cylindrical outer backrest surface to a maximum second surface radius ($r_3$) different from said maximum first surface radius relative to said backrest axis; and wherein at least one of said warp tensioning modules is axially repositionable along said backrest beam along said backrest axis and selectively removable from said backrest beam.

2. The backrest arrangement according to claim 1, wherein said first warp guide surface is a cylindrical segment surface having a first radius of curvature ($r_2$) not more than half of said backrest radius ($r_1$), where said maximum first surface radius ($r_5$) equals said backrest radius ($r_1$) plus said first radius of curvature ($r_2$); and wherein said second warp guide surface is a cylindrical segment surface extending over said second angular range, which is at least 180°, and having a second radius of curvature defined by said maximum second surface radius, which is greater than said maximum first surface radius, uniformly over said second angular range.

3. The backrest arrangement according to claim 1, wherein said first warp tensioning module has a greater axial length extending along said backrest axis than does said second warp tensioning module, said second warp tensioning module has a mounting cutout with a first arc portion matching a contour of and uniformly contacting a portion of said cylindrical outer backrest surface and a second arc portion matching a contour of and engaging around said first warp guide surface, and said at least one of said warp tensioning modules that is axially repositionable is said second warp tensioning module.

4. The backrest arrangement according to claim 1, wherein said second warp tensioning module further comprises two edge rims protruding radially outwardly beyond said second warp guide surface to a rim radius ($r_4$) greater than said maximum second surface radius ($r_3$).

5. A loom for weaving a woven fabric by alternately shedding warp threads and inserting weft threads into successive open warp sheds, comprising:

a warp beam supplying warp threads;

a backrest arrangement that is supported to be oscillatingly rotatable about a backrest axis and that has said warp threads deflected thereover from said warp beam; and a motion transmission that is connected to said backrest arrangement and that is adapted and arranged to oscillatingly rotate said backrest arrangement about said backrest axis;

wherein said backrest arrangement includes a backrest beam having a backrest beam surface, and a first warp tensioning module that is mounted on and extends along an axial length of said backrest beam and that has a first warp tensioning surface which provides a greater warp deflection path length than does said backrest beam surface by itself for said warp threads deflected thereover, such that an oscillating rotation of said backrest arrangement provides a variable tension or elongation compensation for said warp threads deflected over said backrest arrangement.

6. The loom according to claim 5, further in combination with a woven fabric produced on said loom, wherein said woven fabric includes at least two different weave binding patterns.

7. The loom according to claim 5, wherein said first warp tensioning module comprises a first cam member with an outwardly facing first cam surface that protrudes radially outwardly beyond said backrest beam surface relative to said backrest axis and that forms said first warp tensioning surface.

8. The loom according to claim 7, further comprising a second warp tensioning module that comprises a second cam member that reaches and engages entirely around said first cam surface of said first cam member and partially around said backrest beam surface.

9. The loom according to claim 5, wherein said backrest arrangement further comprises at least a second warp tensioning module mounted on said backrest beam, wherein said first warp tensioning module is secured against rotation on said backrest beam and said second warp tensioning module is secured against rotation on said first warp tensioning module.

10. The loom according to claim 5, wherein said backrest arrangement further comprises at least a second warp tensioning module mounted on said backrest beam, and wherein said second warp tensioning module has a second warp tensioning surface which provides a greater warp deflection path length than does said first warp tensioning surface for said warp threads deflected thereover.

11. The loom according to claim 10, wherein said second warp tensioning surface has a U-shaped sectional profile along a section plane extending along said backrest axis.

12. The loom according to claim 5, further comprising a spring element connected to said backrest arrangement so as to apply a rotational bias to said backrest arrangement about said backrest axis.

13. The loom according to claim 12, wherein at least one of said motion transmission and said spring element is removably connected to said backrest arrangement and is thereby adapted to be selectively decoupled from said backrest arrangement.

14. The loom according to claim 5, further comprising a main loom drive shaft, and wherein said motion transmission comprises a drive cam connected to said main loom drive shaft, a rocker followingly connected to said drive cam, a connecting link articulately connected to said rocker, and a lever arm articulately connected to said connecting link and rigidly connected to said backrest arrangement offset from said backrest axis.

15. The loom according to claim 5, wherein said backrest arrangement is supported in said loom to freely oscillatingly rotate about said backrest axis, and said backrest axis is fixed in said loom so that said backrest arrangement cannot carry out a pendular swinging in said loom.

16. A method of compensating warp thread tension or elongation variations that arise in warp threads during shed changes while weaving on a loom, comprising the following steps:

a) supplying a plurality of warp threads;

b) separating said warp threads into at least a first warp thread group and a second warp thread group;

c) deflecting said first warp thread group over a first part of a backrest of the loom and deflecting said second warp thread group over a second part of the backrest of the loom;

d) successively shedding said warp threads to carry out successive shed changes; and e) providing a first compensating of tension or elongation variations that arise in said first warp thread group using said first part of said backrest, and providing a second compensating of tension or elongation variations that arise in said second warp thread group using said second part of said backrest, wherein said first compensating and said second compensating provide different degrees of compensation of said tension or elongation variations of said first and second warp thread groups respectively, and wherein said providing of said first compensating and said providing of said second compensating are respectively carried out so that said degree of compensation provided by said second compensating is zero and said degree of compensation provided by said first compensating comprises an additional tension or an additional deflection path length applied to said first warp thread group cyclically during said shed changes.

17. The method according to claim 16, wherein said first compensating and said second compensating are carried out independently of each other.

18. The method according to claim 16, further comprising inserting weft threads into sheds formed by said shedding and thereby weaving a woven fabric, wherein said weaving comprises forming at least two different weave binding patterns in two sections of said fabric by carrying out different sequences of said shedding and said inserting respectively for said sections of said fabric.

19. The method according to claim 16, wherein said first and second parts of said backrest are first and second tensioning modules that can be separately and separably mounted on a backrest beam of said backrest, and further comprising a preliminary step of mounting said first and second tensioning modules on said backrest beam in a configuration adapted to compensating requirements of a particular woven fabric that is to be woven.

20. The method according to claim 16, wherein said first compensating and said second compensating are carried out cyclically by oscillatingly rotating the backrest about a backrest axis cyclically between a compensating angular position and a non-compensating angular position.

21. The method according to claim 20, wherein at least one of said first compensating and said second compensating comprises increasing a deflection path length of said respective warp thread group over said respective part of said backrest when said backrest is in said compensating angular position in comparison to when said backrest is in said non-compensating angular position.

22. The method according to claim 20, wherein said oscillating rotating of said backrest comprises transmitting an oscillating rotating motion to said backrest from a main loom drive shaft of the loom.

23. The method according to claim 20, wherein said oscillating rotating of said backrest comprises applying to said backrest an oscillating motion independently of a main loom drive shaft of the loom.

24. The method according to claim 20, wherein said oscillating rotating of said backrest comprises carrying out a positively actuated and constrained oscillating rotating of said backrest in combination with a passive unconstrained oscillating rotating of said backrest.

25. The method according to claim 24, carried out so that said positively actuated and constrained oscillating rotating dominates over said passive unconstrained oscillating rotating.

26. The method according to claim 16, wherein said providing of said first and second tension compensations comprises applying a spring bias to the backrest.

27. A method of compensating warp thread tension or elongation variations that arise in warp threads during shed changes while weaving on a loom, comprising the following steps:

a) supplying a plurality of warp threads;

b) separating said warp threads into at least a first warp thread group and a second warp thread group;

c) deflecting said first warp thread group over a first part of a backrest of the loom and deflecting said second warp thread group over a second part of the backrest of the loom;

d) successively shedding said warp threads to carry out successive shed changes; and e) providing a first compensating of tension or elongation variations that arise in said first warp thread group using said first part of said backrest, and providing a second compensating of tension or elongation variations that arise in said second warp thread group using said second part of said backrest, wherein said first compensating and said second compensating provide different degrees of compensation of said tension or elongation variations of said first and second warp thread groups respectively, and wherein said first compensating and said second compensating are carried out independently of each other.

* * * * *